US005348639A

United States Patent [19]

Mitsuji

[11] Patent Number: 5,348,639

[45] Date of Patent: * Sep. 20, 1994

[54] SURFACE TREATMENT FOR IRON-BASED PERMANENT MAGNET INCLUDING RARE-EARTH ELEMENT

[75] Inventor: Katsuo Mitsuji, Alma, Mich.

[73] Assignee: Hitachi Magnetics Corporation, Edmore, Mich.

[ * ] Notice: The portion of the term of this patent subsequent to Feb. 15, 2011 has been disclaimed.

[21] Appl. No.: 740,999

[22] Filed: Aug. 6, 1991

[51] Int. Cl.[5] ..... C25D 5/34

[52] U.S. Cl. ..... 205/181; 205/197; 205/210; 205/217; 427/127; 427/309

[58] Field of Search ..... 205/217, 181, 197, 210; 427/27, 309

[56] References Cited

U.S. PATENT DOCUMENTS

| | | | |
|---|---|---|---|
| 3,090,733 | 5/1963 | Brown | 204/40 |
| 4,100,038 | 7/1978 | Jongkind | 204/38 B |
| 4,384,929 | 5/1983 | Tremmel et al. | 204/40 |
| 5,013,411 | 5/1991 | Minowa et al. | 204/29 |
| 5,082,745 | 1/1992 | Ohashi | 428/552 |

*Primary Examiner*—John Niebling
*Assistant Examiner*—William T. Leader
*Attorney, Agent, or Firm*—Gifford, Groh, Sprinkle, Patmore and Anderson

[57] ABSTRACT

A surface treatment for a R-TM-X type of permanent magnet comprising the steps: Etching the magnet with nitric acid having a concentration of 0.2 to 10 vol %, then etching the magnet with a mixture of oxygenated water having a hydrogen peroxide concentration of 0.2 to 10 vol % and acetic acid having a concentration of 10–30 vol %, and next plating the magnet with a copper plating initially followed by a nickel plating. R represents an element or a mixture of rare earth elements, TM is mainly composed of iron and transition elements other than iron and X represents one or more of a mixture of elements to enhance the coercivity of the magnet. This improvement of the magnet material itself improves the corrosion resistance of the protective film on the magnet surface.

5 Claims, No Drawings

SURFACE TREATMENT FOR IRON-BASED PERMANENT MAGNET INCLUDING RARE-EARTH ELEMENT

BACKGROUND OF THE INVENTION

I. Field of the Invention

The present invention relates to an improvement of surface treatment for an iron-based permanent magnet including rare-earth elements.

More particularly the invention presents a permanent magnet exhibiting high resistivity against mechanical attack, thermal attack and/or chemical attack, as well as comprising superior magnetic properties.

II. Description of the Prior Art

Permanent magnet materials are very important electric and/or electronic materials to be incorporated in various equipment such as consumer electronic equipment used in homes or in a peripheral terminal device for a large scale computer.

Recently, in an attempt to reduce size and enhance efficiency of permanent magnet materials have been sought.

As a new type of high efficiency magnet which does not include highly expensive samarium and cobalt, a R-Fe-B type (R: one element or a mixture of rare-earth elements including yttrium) was proposed.

This type of magnet exhibits an extremely high energy product value, (BH)max of 25 MGOe or more. The magnet contains light rare-earth such as Nd and/or Pr and Fe as its main constituent element.

A sintered magnet of Nd-Fe-B type is disclosed in Japan Laid Open Patent Application 59-46008. A bulk magnet of Nd-Fe-B type made from rapidly quenched metal flakes (Rapidly Quenched Type of Magnet, hereinafter) is disclosed in Japan Laid Open Patent Application 60-9852.

Although these magnets exhibit magnetic anisotropy and have a high energy product of 25 MGOe or more, they are inferior to samarium-cobalt magnets with respect to corrosion resistance, because these magnets include rare-earth elements and also iron, both of which are easily oxidized and form red rust on their surfaces. The efficiency of the magnet and the uniformity of magnetic properties will decrease when these magnets suffer corrosion.

In order to prevent corrosion of these Nd-Fe-B type of magnets, various methods have been proposed to produce a corrosion resistive film on the surface of these magnets.

However, the reliability of these corrosion resistive films is reduced when the adhesion of the corrosion resistive film to the magnet surface is not sufficient, even if the corrosion resistive film still covers the surface of the magnet. It is important to firmly fix the corrosion resistive film to the surface of the magnet.

It seems that no effective improvement was proposed previously to make the adhesiveness of the film to the magnet body stronger by improving the alloy composition itself.

SUMMARY OF THE INVENTION

Accordingly, it is the object of the present invention to improve the corrosion resistance of a permanent magnet by examining the following points:

(1) As a Fe-R-B type magnet is easily affected by machining, the quality of the surface area layer of the worked magnet is changed. The layer is rather thick.

Accordingly, complete separation of the corrosion resistant film would occur at the portions of the magnet surface where the quality was changed. This separation would occur where corrosion resistant film was formed on such a surface of the magnet without removing the quality changed layer.

(2) Production of a corrosion resistive film on a magnet body by initially treating the surface of the magnet body with a strong acid or a similar liquid tends to produce a corrosive layer. As a result the corrosion resistance of the film is extremely reduced.

( 3 ) An improvement of the magnet material itself is also important to improve the corrosion resistance of the protective film on the magnet surface.

This invention is, for example, a surface treatment for a R-TM-X type of permanent magnet comprising the steps, of (1) etching the magnet material in a first solution comprising nitric acid, (2) etching the magnet material in a second solution comprising a mixture of oxygenated water and an acetic acid, ( 3 ) copper plating, and ( 4 ) nickel plating where R represents yttrim or one or more rare earth elements or mixtures thereof, TM is mainly composed of iron and one or more transition elements other than iron and metals that can be partially replaced with one or more other elements, and X represents one of or a mixture of non-metallic and metalloid elements to enhance the coersivity of the magnet. Generally X is one of or a mixture of non-metallic or metalloid elements to enhance the coersivity of the magnet.

In the present invention greater reliability of corrosion resistance of a R-TM-X type of magnet can be achieved also by improving the magnet alloy composition itself.

DETAILED DESCRIPTION OF THE PREFERRED EMBODIMENT OF THE PRESENT INVENTION

In this invention it is preferable that a corrosion resistant film be formed on the surface of a magnet material comprising essentially 5 to 40 wt% of R, 50–90 wt% of TM and 0.2 to 8% of B and including 0.5 to 15 wt% of Co and 0.5 to 5 wt% of aluminum.

It is possible to make the corrosion resistance of a permanent magnet stronger by conducting the above described steps of surface treatment for the magnet material. The surface treatment comprises the steps of first etching by nitric acid and then etching a second time by a mixture of acetic acid and oxygenated water before a coating or plating process.

The boundary phase of a R-Fe-B type of magnet alloy comprises almost a rare-earth rich phase which includes several wt% of Fe and few boron and a boron rich phase of $R_{1+c}TM_4B_4$ when the magnet does not include Co or Al. In such a case an inferior corrosion resistance of the magnet would be caused by the rare-earth rich phase which is chemically active because of the plentitude of the rare-earth element.

By the addition of Co and Al, the boundary phase of a R-Fe-B type of permanent magnet becomes a multiple phase by inclusion of Co and Al into the boundary phase.

By adjustment of the amount of Co and Al in the permanent magnet, it is possible to enhance the corrosion resistance of the magnet without reducing the magnetic properties. Co is effective to enhance its Curie temperature, the corrosion resistance of the magnet material, and the magnetization value, Is. However a less than 0.5 wt% of Co does not well work to enhance these properties. On the contrary 15 wt% or more of Co reduces the coercive force iHc by causing precipitation of R-Co compound comprising 40 wt% or more of Co caused by a great amount of condensation of cobalt at the crystalline boundaries which make a reverse of magnetization easier. The most preferable range of Co amount is 0.5 wt % to 15 wt% and more preferably 1 wt% to 10 wt%.

Aluminum element is effective to enhance iHc and the corrosion resistance by preventing reduction of iHc caused by increase of Co amount in the magnet. A less than 0.5 wt% of Al is not so effective to enhance iHc and the corrosion resistance, and on the contrary 5 wt% or more of Al causes a reduction of Br and (BH)max although it is still effective to increase iHc. The most preferable range of Al content is 0.5 wt% to 5 wt%.

Although the idea to coat a resin layer on a surface of magnet material including Co and Al is disclosed in Japan Laid Open Patent Application 63-77104, the protective layer of resin is inferior to a metal plating layer.

As the resin layer is mechanically weaker than a metal plating layer, a scratch may be easily made on the resin layer during handling or a similar operation necessary to insert the resin coated magnet into electric equipment.

The scratched portion of the resin layer becomes a starting point for the destruction of the magnet where the magnet material may be attacked by corrosives through the destroyed portions of the resin layer. Even if the resin layer is not scratched, it is inferior to a metal plating layer, because the resin layer is very hygroscopic. In the present invention, it is preferable to coat the surface of a magnet body by a metal plating film.

In the present invention TM of the magnet material can include Ga, Ti, V, Cr, Mn, Zr, Hf, Nb, Ta, Mo, Ge, Sb, Sn Bi, Ni and other elements other than Co and Al.

The present invention can be applied to various permanent magnets produced by a powder metallogical process or a process comprising a rapid quenching of a molten metal. The latter process generally comprises a compression step to form a compressed body of powder made of the rapidly quenched material in hot atmosphere and a hot working process to provide the magnet body with a magnetic anisotropy caused by a plastic deformation in a hot atmosphere. The formed bulk magnet is characterized by fine crystalline size. The magnet generally has an average crystalline size of 0.02 um to 1.0 um. The magnet of the present invention can be produced by modifications of those processes described above.

In order to produce a reliable protective film on a magnet surface, it is important to remove a layer where the quality of the layer was changed by, for example, a working process or cutting process.

Such a layer generally has a thickness of 5 um to 20 um. The layer is qualitatively changed by grinding, cutting or similar mechanical processes.

Although previous methods to remove such a changed layer and to make the magnet surface active employed using a sulfuric acid or a similar acid before a metal plating process, a plated metal film was separated by corrosion under the plating layer caused by the remaining effect of these extremely strong treatments.

In this invention the first etching by 0.2 to 10 vol % of nitric acid and the second etching by a mixture of 0.2 to 10 vol % of oxygenated water and 10 to 30 vol % of acetic acid before a copper plating and a nickel plating after the copper plating is preferable to improve the corrosion resistance of the protective film on the surface of magnet material.

The nitric acid removes the quality changed layer of the magnet material and the mixture of oxygenated water and acetic acid makes the magnet surface active. This treatment enhances adhesiveness of the metal film formed by a plating process to the magnet surface.

In this invention the Ni-plating is preferably conducted after the Cu-plating.

The Cu-plating can be electrically conducted by using an electrolyte comprising 100 g/l of phosphate of copper, 250 g/l of polyphosphate of copper adjusted by calcined soda to make the pH-value 7.5 to 9. The electric current density is preferably 1 to 5 A/dm$^2$ in 40° C. to 60° C. of solution.

Also a non-electrolytic Cu-plating layer can be formed in the present invention. A non-electrolyte for Cu-plating can include 10 g/l or less of one or a mixture of copper phosphate, copper nitrate, copper chloride, 200 g/l or less of one or a mixture of formalin, hydrazine, derivatives of hydrazine, hydroquinone, hypophosphorous acid soda, pseudo-acid sale, cane sugar and a similar compound material.

The electrolyte can also include 180 g/l or less of one or a mixture of rochelle sale, EDTA, triethanolamine, glycon acid salt, salicylate, and 100 g/l or less than 100 g/l of carbonate, ammonia, cyanide of sodium as a PH-adjustment or a relaxation agent and also 10 g/l or less than 10 g/l off phosphate, di-phosphates, chlorides, fluorides, surface tension activator as a reaction promoting agent or a stabilizing agent.

A Ni-plating can be conducted by a process using a watt solution, a sulfamino acid solution or an anmon solution. The Ni-plating is preferably a bright plating in case of a single Ni-plating layer. A non-bright plating is not preferable to be used to form a single Ni-layer of protective film, because it includes a colluminar structure. But a non-bright Ni-plating layer is effective to be used as an underlying layer because of its strong adhesive characteristics and the low level of stress maintained in the plated metal film. The thickness of the plated Ni-layer preferably totals about 5 to 30 um totally.

It is preferable to conduct a chromate treatment and then a resin coating after the metal-plating to enhance the corrosion resistance of the protective layer.

It is necessary to sufficiently clean the magnet material surface with water before the metal plating process. The water cleaning is important just before the plating process. The water cleaning is effective to remove dust produced in a pre-plating step or chemicals used in the pre-plating process in order to avoid introducing these undesirables into the plating process. Dust and foreign material would cause an insufficient adhesiveness of the plated metal layer to the magnet surface and/or a reduction of plating efficiency of the plating solution.

The Ni-plating layer can be formed by an electrolytic plating. In case of an electrolytic plating, the following solution constituents can be used.

The bath includes 50 to 500 g/l of one or a mixture of nickel ammonium sulfate, nickel sulfate, nickel chloride, sulfamic acid nickel, tetrafluoro-nickel borate as a nickel salt, 10 to 50 g/l of ammonium chloride, 10 to 50 g/l of boric acid. If necessary it can include sodium lauryl sulfate, hydrogen peroxide to prevent pits, a first bright brightener such as benzene, naphthalene, saccharin and other material and further a second brightener such as butene-diol, coumarin, thiourea and similar material.

The plating solution has generally a temperature of 20° C. to 70° C. and preferably a pH-value of 2.0 to 7.0. The cathode current density is preferably a value of 0.1 to 10 A/dm$^2$. The Ni film produced by the plating solution is mainly made of nickel but can include iron, copper, manganese, zinc, cobalt, carbon, and oxygen as impurities. The solution can contain alloying salt to produce a Ni-alloy film. The plated film can be a Ni-alloy film including the added metals produced by adding nickel salt and other metal salt in the plating solution.

The element to be alloyed with nickel is generally an element or a mixture of Sn, Cu, Zn, Co, Fe, Cr, P, B and other metal elements. As phosphor belonging to metalloid elements makes the plates Ni-P film amorphous, the Ni-P film is superior to a plated Ni film with respect to corrosion resistivity. The Ni-P film is also provided with a reduced number of pin-holes compared to a Ni-plated film. Moreover, the Ni-P film is mechanically stronger and more resistive against salt and other chemicals. Such a Ni-plated film can generally be produced by a non-electrolytic plating process. The solution is, for example, a solution of sulfate of nickel which can include hypophosphorous acid as acetifier and acetate soda as a stabilizer. A Ni-base of multiple layers can be formed. Although the same number of solutions as the number of layers are needed, such multiple layers can provide a sacrifice anode effect by an interlayer corrosion mechanism which is effective to improve the corrosion resistance of the layers.

Remaining stress in the plated metal layer formed on a magnet surface weakens the adhesiveness of the plated metal film to the magnet surface. Generally in corrosion test the corrosion proceedings under the plated film on the magnet surface cause almost all defects of the metal plated film. Such a corrosion causes a loss of adhesion between the magnet surface and the plated metal film.

Although each thickness of plated metal films can be varied in view of the corrosion resistance to be required, a practical thickness is a value of 1 um to 100 um.

The copper plating before the nickel plating is effective to reduce the number of pin-holes in the plated nickel film and to improve the uniformity of the plated nickel film.

The plated copper layer under the plated nickel film improves plating ability of the nickel-plating solution. For example, a complex shaped magnet can be well plated by nickel because an underlying plated copper and a uniform thickness of nickel film can be formed. A magnet ring can be plated by nickel because of the underlying plated copper.

A preferable thickness of the plated copper film is a value of about 0.5 um to 15 um.

The corrosion resistance is too weak if the thickness of the nickel film is a value of less than 1 um. On the contrary, economically it is not preferable if the thickness of the nickel film is greater than 100 um. A preferable thickness of the nickel-plating film is about 5 um to 20 um. The nickel plating can be conducted for objects by hanging or hooking means or containing the objects in a barrel. The two methods can be selected on basis of the size, shape and number of objects to be plated.

The time period for nickel plating can be varied in relation to the thickness of the metal layer to be plated and the plating current density. Generally the current density for nickel plating is controlled to be rather low to thereby minimize the uniformity of the thickness of the plated metal film in the case of barrel plating. Accordingly, the plating period for the barrel plating is longer than for the hooking process to obtain a certain thickness of plated nickel film. The plated nickel or nickel-alloy film on the magnet surface generally has a Vicker's hardness of 100 to 300 and a strength of 50 to 130 kpsi.

Sometimes a plated nickel film is colored in brown or a dark black although a Ni-plated film is effective to prevent corrosion of a magnet. In order to prevent the coloring of the Ni-plated film, it is effective to conduct a chromate treatment by dipping the nickel plated magnet in a solution including chromate oxide. By a chromate treatment, discoloration of the plated Ni film can be prevented. It is also possible to educe chrome to form a film having a thickness of 1 um or less by flowing electric current through the magnet body. Such a Cr-film protects the magnet surface by forming a passive film and retaining the beauty of the magnet.

With respect to pre-plating treatment, acid is generally used to remove a quality-changed layer of a magnet body and also to make the surface active.

Although a strong acid as sulfuric acid or hydrochloric acid is effective to activate the magnet surface, it is necessary to treat the magnet surface first with a 0.2 to 10 vol % of nitric acid and then secondly to treat the magnet surface by a mixture of 0.2 to 10 vol % of hydrogen peroxide solution and 10 to 30 vol % of acetic acid. Following the treatments, the magnet body is nickel-plated after copper-plating.

By the addition of a certain amount of Co and Al in the magnet alloy a more improved corrosion resistance of the magnet can be produced. The addition of Al compensates a reduction of iHc, an increase of variance of magnetic properties after heat-treatment caused by a Co element included to increase the corrosion resistance of the magnet alloy. The Al added has the effect of increasing the corrosion resistance of the permanent magnet. The complex addition of Co and Al increases adhesiveness of the Ni-film to the magnet body.

EXAMPLE 1

Initially an ingot having a composition $Nd(Fe_{0.7}Co_{0.2}B_{0.07}Ga_{0.03})_{6.7}$ made by an arc-melting process was pulverized to form a coarse powder by a stand-milling process and then by a disk-milling process. By a jet-milling process using nitrogen gas as grinding medium, a fine powder of the alloy resulted and had an average particle size of 3.6 um(FSSS).

The fine powder was formed to produce a green body in a magnetic field of 18 kOe being perpendicular to the compression direction. The pressure for compression was 2.3 tons/cm$^2$. The green body was sintered in a vacuum for two hours at a temperature of 1100° C. The sintered body was cut to produce a test piece having a size of 20×12×6 mm.

The test piece was heated to a temperature of 900° C. during 2 hours in Ar atmosphere, and then cooled rapidly to 600° C. and then kept at 600° C. during one hour.

The test piece was surface-treated as follows. After a surface degrease treatment by trichloroethane, the test piece was etched a first time by 1 vol % of nitric acid and then washed by water. The piece was etched a second time by a mixture of 5 vol % of hydrogen peroxide solution and 20 vol % of $CH_3COOH$ solution and then washed by water.

The etched body was plated with 4 um thickness of copper and then by 10 um thickness of nickel. Such a copper layer can be formed by the following steps.

In an electrolytic solution of 100 g/l of copper phosphate, 250 g/l of polyphosphoric acid and caustic soda to adjust the pH value of the solution to a value of 7.5 to 9.

A current density of 5 A/dm$^2$ flowed at a temperature of 50° C. to conduct the copper plating. A Ni-plating was conducted in a bright watt solution.

For a comparison, about 1 minute of surface treatment by a 2 vol % of nitric acid was conducted for a magnet surface.

To evaluate the oxidation-resistance of the magnet, observations were made of the flaking of the metal plating film caused by oxidation after the magnet was kept at a temperature of 120° C. at a pressure of 2 atmospheres, and in a 100 % of humidity after peeling off the metal-plating film at the corner edges. The test pieces produced by this invention showed peeling of the metal-plating film does not occur, while on the comparative test piece a peeling of the metal plating film occurred about 10 hours later.

The corrosion resistance of the comparative test pieces was inferior to the sample test piece and the portions damaged by corrosion under the plated metal film were recognized.

Thermal demagnetization properties were measured for both the sample pieces according to the invention and the comparative pieces which were magnetized in a magnetic field of 25 KOe after being kept at a temperature for one hour.

The demagnetization of the sample was found to be much smaller than one of the comparative test piece. It was concluded that the pre-plating treatment is too strong for the comparative test pieces.

EXAMPLE 2

Initially various alloys respectively having the following compositions were melted by arc and formed into ingots.

Sample No. 1 (wt%)

Nd:29; Dy:1.7, B:0.9, Ga:1.2, Co:10, Al:5, Fe:bal

Sample No. 2 (wt%)

Nd:29, Dy:1.7, B:0.9, Ga:1.2, Co:8, Al:4, Fe:bal

Sample No. 3

Nd:29, Dy:1.7, B:0.9, Ga:1.2, Co:5, Al:2, Fe:bal

Sample No 4

Nd:29, Dy:1.7, B:0.9, Ga:1.2, Co:3, Al:1, Fe:bal

Comparative Sample No. 1 (wt%)

Nd:29, Dy:1.7, B:0.9, Ga:1.2, Fe:bal

Comparative Sample No. 2 (wt%)

Nd:29, Dy:3, B:0.9, Ga:1.2, Fe:bal

Each of the ingots was coarsely crushed in an Argon atmosphere by a stamp-mill and a disk-mill. The coarse powder was milled more to produce fine powder having a particle size of 3.5 um(FSSS) by a jet-mill using nitrogen gas as a milling medium. The fine powder was used to obtain green bodies by 2.3 tons/cm$^2$ of pressure in a magnetic field of 18 KOe perpendicular to the pressing direction. The obtained green bodies were sintered in a vacuum at a temperature of 1100° C. for two hours. Several test pieces have been cut off from the sintered bodies. The test pieces have a size of 20×12×6 mm. They were heat-treated at a temperature of 900° C. for 2 hours in Argon atmosphere, and then quenched to a temperature of 600° C. and kept at this temperature for one hour in Argon atmosphere.

These pieces were etched first by 4 vol % of nitric acid and then etched second by a mixture of 8 vol % of hydrogen peroxide solution and 19 vol % of acetic acid, all done before the metal plating process.

The etched pieces were first plated by Cu to form a 5 um of Cu film and then secondly by Ni in a bright watt solution to form a 12 um of Ni film. These plated pieces were examined by a corrosion test. For comparison, the samples of Nos. 1 to 4 and the comparative samples No. 1 and No. 2 were treated by the same process as described above. The test was to make a thorough examination for the presence of separation of the metal plated film caused by oxidization. These samples were exposed in conditions of temperature at 120° C. at a pressure of 2 atmospheres and 100% of humidity after each plated film on the magnet surface was separated at the corner edges at the starting time.

No separation of the metal plated film on the samples No. 1 to No. 4 was observed even 100 hours following the starting time of the test. The permanent magnets produced according to the present invention are provided with excellent resistivity against corrosion because of a strong adhesiveness of metal plated film to the magnet body and also because of excellent magnetic properties in comparison with previously known magnets.

On the contrary the metal plated film of the comparative samples No. 1 and No. 2 were respectively separated after 38 hours and 43 hours after the starting time of the test.

EXAMPLE 3

An alloy ingot having a composition $(Nd_{0.8}Dy_{0.2})(Fe_{0.85}Co_{0.05}B_{0.08}Ga_{0.02})_{6.8}$ was produced by an arc melting process. Coarse powder was produced by stamp-milling and disk-milling the ingot.

The coarse powder was milled more to produce fine powder having a particle size of 3.6 um(FSSS) by a jet-mill using nitrogen gas as milling medium.

The fine powder was used to obtain green bodies by a 2.3 tons/cm$^2$ of pressure in a magnetic field of 18 KOe which is perpendicular to the pressing direction. The obtained green bodies were sintered in a vacuum at a temperature of 1100° C. for two hours. Several test pieces were cut off from the sintered bodies. The test pieces had a size of 20×12×6 mm. They were heat-treated at a temperature of 900° C. for 2 hours in Argon atmosphere, and then quenched to a temperature of 600° C. and kept at this temperature for one hour in Argon atmosphere.

These pieces were etched first with 3 vol % of nitric acid and were then etched with a mixture of 6 vol % of hydrogen peroxide solution and 25 vol % of acetic acid, all done before the metal plating process.

The etched pieces were first plated with Cu to form a 5 um of Cu film and were then plated with Ni in a bright watt solution to form a 10 um of Ni film. Then these plated pieces were treated by chromic acid. These samples were examined by a salt water spray test using 5 vol % of NaCl solution at a temperature of 35° C. for 100 hours. No red rust was recognized on the surface of the samples after the 100 hours of salt water spray test. The corrosion resistivity of the R-TM-B magnets can be enhanced by the water-repelling property of the chromate-film covering the nickel plated film on the magnet surface.

The chromic acid treatment can be conducted by dipping the metal plated magnets in a chromate solution, after water cleaning of the metal plated magnets. The chromate treatment can be preferably conducted under the conditions of a temperature of 20° C. to 80° C. and a dipping time of up to 10 minutes.

A chromate solution is preferably a high acidity of chromic acid anhydride or dichromic acid, and it is preferably provided with a chrome concentration of 0.01 mol/l or more. A low acidity of chromic acid is not preferable because a non-water repelling chromate film would be formed. It is preferable to use a high acidity of chromic acid also in order to make dipping treatment active. Preferably a strong acid such as sulfuric acid, hydrochloric acid or nitric acid is not included in the chromic acid solution. An inclusion of a strong acid in the chromic acid solution for the chromate treatment would cause too strong an activation of the chromic acid and sometimes create a solution of the plated metal film on the magnet surface which weakens the adhesiveness of the chromate film to the plated metal film. Moreover it is possible for such a strong acid to cause corrosion in the magnet body where the strong acid penetrates the magnet through pin-holes in the plated metal film. Accordingly a strong acid without these strong acids is preferable.

The magnets are dried at a temperature of 20° C. to 120° C. after water washing and after dipping in a chromic acid solution. As an excess heating of the magnets makes the corrosion resistance of the chromate film weak, the drying temperature should not exceed 120° C.

EXAMPLE 4

An alloy ingot having a composition $Nd(Fe_{0.7}Co_{0.2}B_{0.08}Ga_{0.02})_{6.7}$ was produced by an arc-melting process. Coarse powder was produced by stamp-milling and disk-milling the ingot.

The coarse powder was milled more to produce fine powder having a particle size of 3 6 um(FSSS) by a jet-mill using nitrogen gas a milling medium.

The fine powder was used to obtain green bodies by a 2.3 tons/cm$^2$ of pressure in a magnetic field of 18 KOe which is perpendicular to the pressing direction. The obtained green bodies were sintered in vacuum at a temperature of 1100° C. for two hours. Several test pieces have been cut off from the sintered bodies. The test pieces have a size of 20×12×6 mm. They were heat-treated at a temperature of 900° C. for 2 hours in Argon atmosphere, and then quenched to a temperature of 600° C. and kept at that temperature for one hour in Argon atmosphere.

These pieces were first etched by 3 vol % of nitric acid and were then etched by a mixture of 6 vol % of hydrogen peroxide solution and 25 vol % of acetic acid, before metal plating process.

The etched pieces were first plated by Cu to form a 4 um of Cu film and were then plated a second time by Ni in a bright watt solution to form a 10 um of Ni-6wt%P alloy film These plated pieces were examined by a corrosion test to make a thorough examination for the presence of red rust on the magnets caused by oxidization. These samples were exposed in a conditions of 80° C. at a pressure of one atmosphere and 90% humidity. No red rust on the metal plated film of the samples was observed even 1000 hours after the starting time off the test. The permanent magnets produced according to the present invention are provided with excellent resistivity against corrosion because of the strong adhesiveness off metal plated film to the magnet body and their excellent magnetic properties with in comparison with previously known magnets.

By this invention iron-based permanent magnets including rare-earth elements can be provided with excellent corrosion resistivity.

I claim:

1. A surface treatment for R-TM-X permanent magnet material comprising the following steps after mechanical working and degreasing treatment, (1) etching the magnet material in a first solution comprising nitric acid having a concentration of 0.2 to 10 vol %, (2) etching the magnet material in a second solution comprising a mixture of oxygenated water having a hydrogen peroxide concentration of 0.2 to 10 vol %, and acetic acid having a concentration of 10 to 30 vol %, (3) copper plating to form a 0.5 to 15 μm thick copper layer on the magnet material, and (4) nickel plating to form a 1 to 100 μm thick nickel layer on the copper layer, where the magnet material consists essentially of 5–40% by weight of R, 50–90% by weight of TM and 0.2 to 8.0% by weight of X, and where R consists of yttrium or one or more rare earth elements or mixtures thereof, TM consists of iron as its main component and one or more transition metals other than iron, said one or more transition metals being partially replaceable with one or more other elements, and X consists of at least one non-metallic element or metalloid element or mixture thereof to enhance the coercive force of the magnet material.

2. A surface treatment for a R-TM-X permanent magnet material according to claim 1 where X consists essentially of boron, R is composed of a mixture of neodymium, praseodyumium and dysprosium and TM includes 0.5 to 15 wt% of Co and 0.5 to 5 wt% of aluminium to enhance its corrosion resistance.

3. A surface treatment for a R-TM-X permanent magnet material according to claim 1 where the magnet material is a magnetically anisotropic hot-worked magnet having an average crystal size of 0.02 to 1.0 um and being made from rapidly quenched alloy flakes by a hot working process comprising a hot compression and a plastic deformation in a temperature ranging 600° C. to 800° C.

4. A surface treatment for a R-TM-X permanent magnet material according to claim 1 where the magnet material is a magnetically anisotropic sintered magnet made by powder metallurgical process.

5. A surface treatment for R-TM-X permanent magnet material comprising the steps, of (1) etching the magnet material in a first solution comprising nitric acid having a concentration of 0.2 to 10 vol %, (2) etching the magnet material in a second solution comprising a mixture of oxygenated water having a hydrogen peroxide concentration of 0.2 to 10 vol %, and acetic acid having a concentration of 10 to 30 vol %, (3) metal plating to form a 1.5 to 115 μm thick metal layer on the magnet material, and (4) non-metal coating to form a non-metal layer on the metal layer, where the magnet material consists essentially of 5–40% by weight of R, 50–90% by weight of TM and 0.2 to 8.0% by weight of X, and where R consists of yttrium or one or more rare earth elements or mixtures thereof, TM consists of iron as its main component and one or more transition metals other than iron, said one or more transition metals being partially replaceable with one or more other elements, and X consists of at least one non-metallic element or metalloid element or mixture thereof to enhance the coercive force of the magnet material.

* * * * *